United States Patent [19]

Manaugh

[11] 3,960,282

[45] June 1, 1976

[54] CAR PARKING STRUCTURE WITH A CAR LIFT AT THE ENTRANCE THEREOF

[76] Inventor: Carlisle F. Manaugh, 522 Abramar Ave., Pacific Palisades, Calif. 90272

[22] Filed: July 15, 1974

[21] Appl. No.: 488,571

[52] U.S. Cl. ..... 214/16.1 CB; 214/16.1 C

[51] Int. Cl.[2] ..... E04H 6/06

[58] Field of Search ..... 214/16.1 R, 16.1 CB, 214/16.1 C

[56] References Cited

UNITED STATES PATENTS

| | | | |
|---|---|---|---|
| 2,714,456 | 8/1955 | Manaugh | 214/16.1 C |
| 2,722,322 | 11/1955 | Gunderson | 214/16.1 CB |
| 2,890,802 | 6/1959 | Alimanestiane | 214/16.1 CB |

FOREIGN PATENTS OR APPLICATIONS

| | | | |
|---|---|---|---|
| 1,061,502 | 7/1959 | Germany | 214/16.1 CB |

*Primary Examiner*—Robert J. Spar
*Assistant Examiner*—R. B. Johnson
*Attorney, Agent, or Firm*—Keith D. Beecher

[57] ABSTRACT

A car parking system comprising a plurality of spaced, multiple tier parking structures, separated by craneways, and horizontally and vertically movable cranes in the craneways for storing a large number of cars in a given area. A lift platform is provided on the ground story for elevating the cars a particular distance up from the ground to permit them to be received by traverse dollies and loaded into the elevator platforms of the cranes; and which also permit the cart to be unloaded from the cranes by reversing the process.

4 Claims, 8 Drawing Figures

CAR PARKING STRUCTURE WITH A CAR LIFT AT THE ENTRANCE THEREOF

BACKGROUND OF THE INVENTION

Mechanical parking systems are well known in which cars are loaded by suitable crane mechanisms into stalls arranged in multiple tiers. One type of such prior art parking systems utilizes a craneway running between two, multiple story, parking structures, the parking structures have a row of stalls on each story to receive the cars from the elevators. Such a system is described, for example, in U.S. Pat. No. 2,714,456, which issued in the name of the present inventor.

In the system described in the patent, a series of structural units extend transversely across a parking lot, and the units are spaced from one another by the craneways. Each structural unit described in the patent comprises a ground story and multiple tiers above the ground story. The units are of substantially rectangular shape as seen in plan view, and they include a longitudinal row of transversely disposed stalls on each story. Elevator mechanisms adapted to move both vertically and horizontally in the craneways to service the various stalls.

U.S. Pat. No. 2,840,248 which issued June 24, 1958, describes a self-propelled traverse dolly, one of which may be carried on each elevator platform in the above described system for moving the cars onto and off the elevator mechanisms, both at ground level and at the selected stalls on the selected stories of each parking unit.

In the operation of the prior art parking system described above, a car is parked by its owner in a loading area on the ground level adjacent to one of the craneways of the system. The operator of the parking facility then controls one of the elevator mechanisms to bring the elevator platform to its ground level loading position in alignment with the car. The self-propelled traverse dolly is then operated to move it off the elevator platform, and under the car, and then to move it and the car onto the elevator platform. The elevator platform is then elevated, and the elevator mechanism is then moved horizontally to a position in alignment with a selected stall of the system. The dolly is again operated to move it and the car from the elevator platform into the selected stall. The dolly is then returned to the elevator platform. The operation of the system is reversed when the car is to be redelivered to its owner.

In the system of the present invention, a cleat lift platform is provided in each of a variety of locations on the ground floor of the car parking system in positions for permitting cars to be loaded onto, or unloaded from, the elevator platforms in the elevator mechanisms in the various craneways by the traverse dollies. Each cleat lift platform is controlled to raise a supported car up a predetermined distance on traverse cleats, so as to permit the corresponding dolly to move under the car, extend its transverse supporting forks between the cleats, raise the car on its forks up from the cleats, and load the car onto the elevator platform; and to repeat the process on the return of the car.

DETAILED DESCRIPTION OF THE ILLUSTRATED EMBODIMENTS

Figure 1:
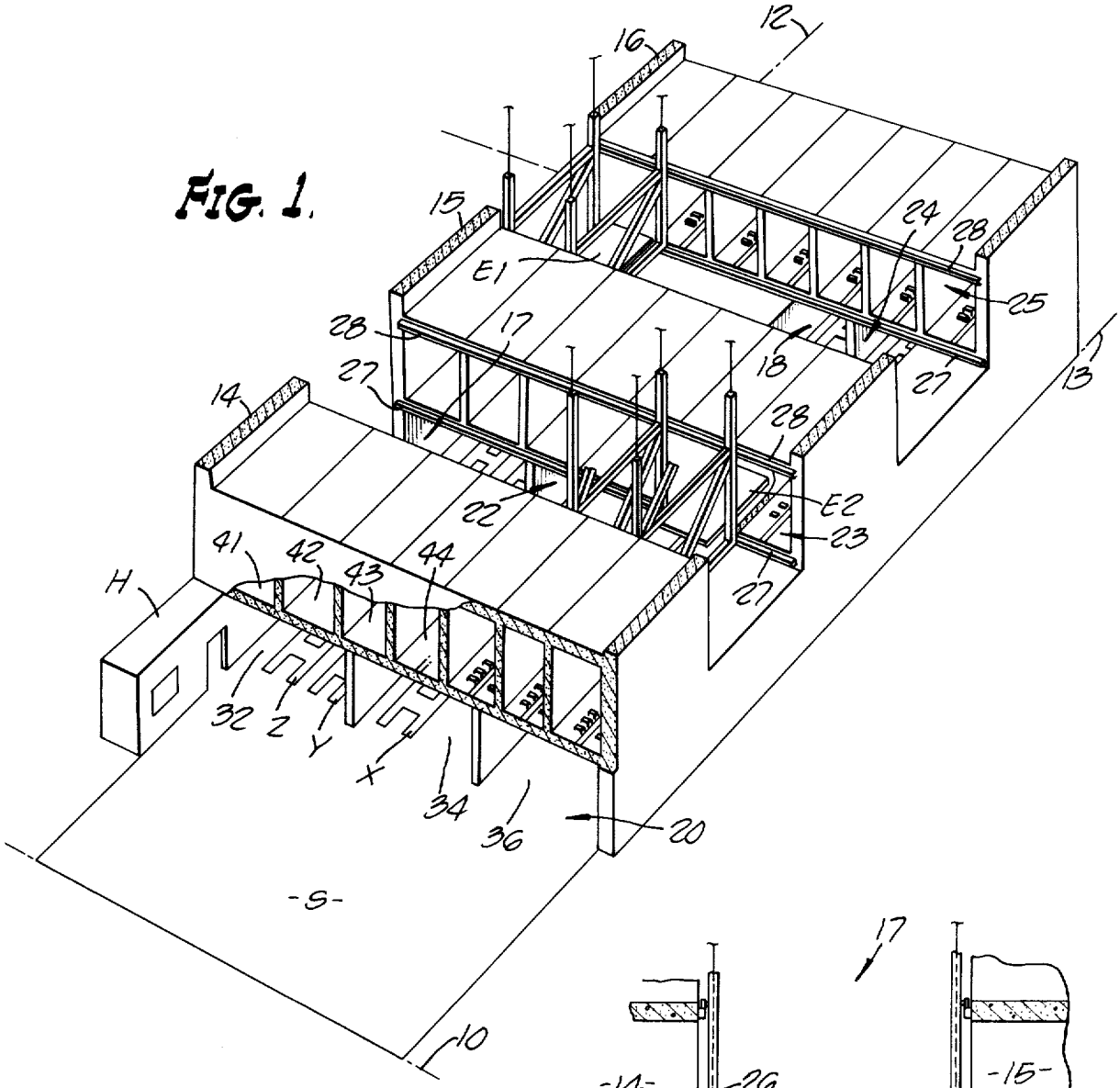
FIG. 1 is a diagrammatic perspective view of a portion of an illustrative car parking system which may incorporate improved lift cleat platforms, in accordance with the invention, on its ground floor loading and unloading areas.
Figure 2:
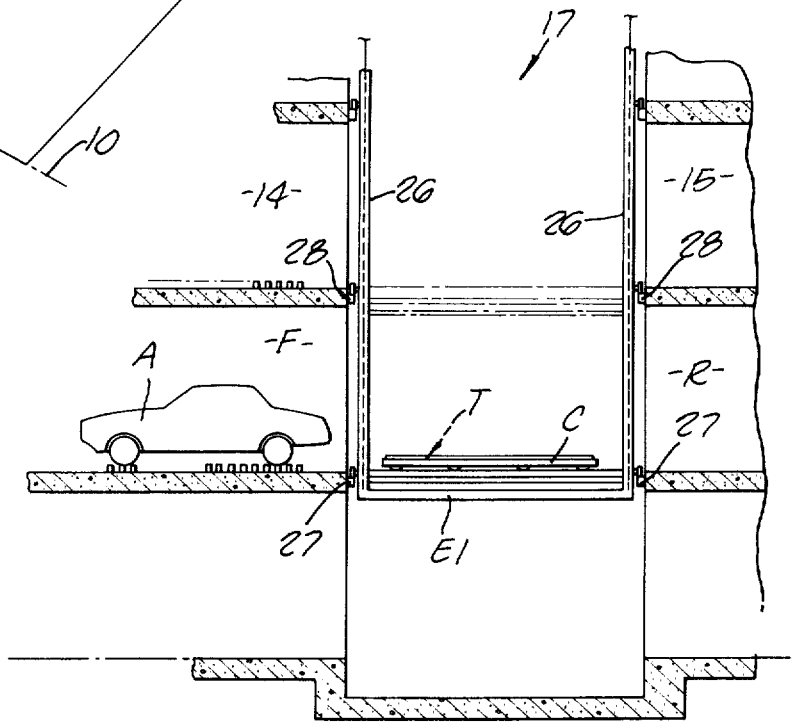
FIG. 2 is an enlarged elevational view showing the manner of operation of an elevator mechanism in one of the craneways, of the car parking system, and also showing a traverse dolly mechanism for moving the cars on and off the elevator.
Figure 3:
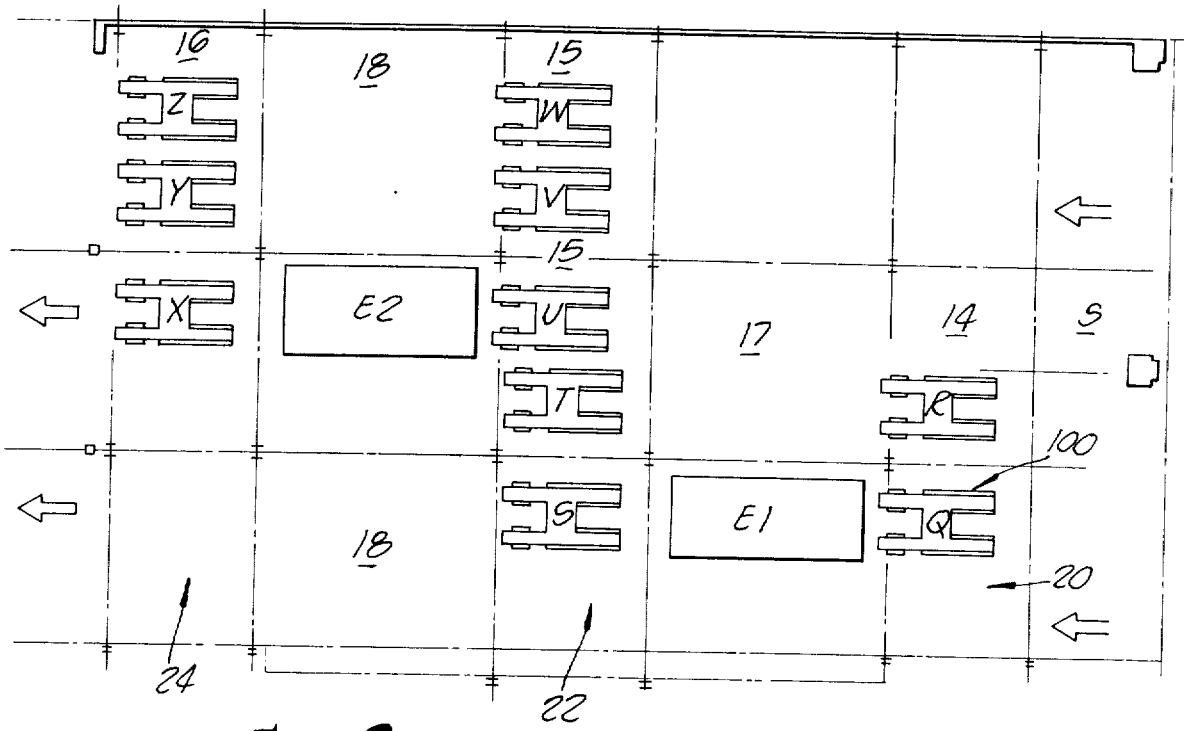
FIG. 3 is a top plan view of the ground floor of one of the parking structures in the system of FIG. 1, with various details omitted, and showing the locations of various cleat lift platforms on the ground floor.

Referring to FIGS. 1–3, there is shown a parking lot bounded by a front boundary line 10 and by a rear boundary line 11. The sides of the lot are confined by side boundary lines 12 and 13. The illustrated parking system includes an open area or space S at the front entrance with a cashier's office H at one side.

The system includes three structural units 14, 15 and 16 of generally rectangular shape, as seen in plan view, the structural units being disposed transversely of the lot and spaced from one another longitudinally of the lot. A first craneway 17 is provided between the units 14 and 15, and a second craneway 18 is provided between the units 15 and 16. The craneway 17 accommodates an elevator mechanism E1 which is adapted to move vertically and horizontally within the craneway as indicated by the arrows. The craneway 18 accommodates a similar elevating mechanism E2.

The structural unit 14 comprises a ground floor 20 and multiple stories only one of which is shown as 21 for reasons of simplicity. Similarly, the structural units 15 and 16 respectively include a ground floor 22, a first story 23, and other upper stories, not shown; and a ground floor 24, a first story 25, and other upper stories, not shown.

A traverse dolly T is supported on the platform of the elevator mechanism E1, and it embodies a carriage C with retractable transverse forks which are adapted to reach under the wheels of a car A and lift up the car. The dolly then moves the car onto the elevator platform, and subsequently moves the car out of the elevator into a selected stall on a selected upper story. The forks lower the car onto supports on the stall floor, and are then retracted and the dolly is returned to the elevator. Such a dolly is described, for example, in U.S. Pat. No. 2,840,248, as mentioned above.

By use of the elevator mechanism E1 and the traverse dolly T, an automobile such as shown at A may be deposited into, either a front stall F or a rear stall R, on any floor, in one or the other of the two structural units served by that particular elevator mechanism, and the car may be subsequently retrieved from the stall by a reverse operation.

The elevator mechanism E1 with its traverse dolly T is adapted to move vertically in a supporting frame 26, disposed in the craneway 17. The frame 26 is in turn movably mounted at its lower end on rails 27 extending longitudinally along the sides of the craneway at any level above the first story, and rails 28 similarly longitudinally extending along the craneway at a higher level. The construction is such that the elevator E1 may be lowered from the frame 26 to receive and deliver cars to and from the ground floors of the various structural units.

Referring again to FIG. 1, the ground floor 20 of structural unit 14 comprises three entrance stalls 32, 34 and 36. These stalls are constructed to accommodate the cleat lift platforms in accordance with the present invention. The entrance stalls are made somewhat larger than the stalls of the upper stories, in order to permit the car doors to be opened and people to climb in and out of the cars. On the first story 21 of unit 14, for example, seven stalls 41, 42, 43, 44, 45, 46, and 47 may be accommodated, since the cars may be more closely packed than on the ground floor because there is no occasion to pen the car doors.

The traverse dolly T, as described in U.S. Pat. No. 2,840,248, engages the car A under its wheels so that the weight of the car is supported in a normal manner without any possible damage to the car. The dolly is a self-propelled vehicle consisting of forward and rear lift sections and an intermediate propulsion carriage section C. The forward and rear lift sections of the dolly have horizontally extendible and retractable, and vertically movable car-supporting forks mounted on opposite sides of the lift sections, and extending transversely of the longitudinal axis of the dolly.

These forks are positioned to be projected between spaced elongated car wheel-supporting members on the upper floors of the structural unit, which define the various parking stalls. The cleat lift platforms in the system of the present invention provide similar spaced elongated car wheel-supporting members at the ground level for permitting the dolly to move under the supported car and to load the car onto the elevator mechanism. The elongated members in each stall on the upper stories, define a central runway therebetween for the dolly. The cleats on the lift platforms, define similar runways for the dolly.

On the ground floor, for example, a dolly is moved along the runway on one of the lift platforms, after the platform has been elevated to its upper position, with a car may be supported on its cleats. The dolly is moved along the runway between the cleats of the lift platform to a position under the car, with its forks retracted. The forks at the forward and rear lift sections of the dolly are then extended between the cleats of the lift platform, and they are moved upwardy to lift the car up from the cleats on the lift platform, and to cause the car to be supported by the forks of the dolly. The dolly then moves itself and the car along the runway back onto the elevator platform, and the elevator mechanism carries the dolly and car up to a selected stall on a selected story. The dolly then propels itself along the runway between the elongated car wheel-supporting members of the selected stall, and its forks are then lowered between the members of the stall and retracted, so that the car rests on the support members of the stall. The dolly is then returned along the stall runway back to the elevator mechanism. As mentioned above, to return the car to the owner, the process is repeated.

Figure 4:
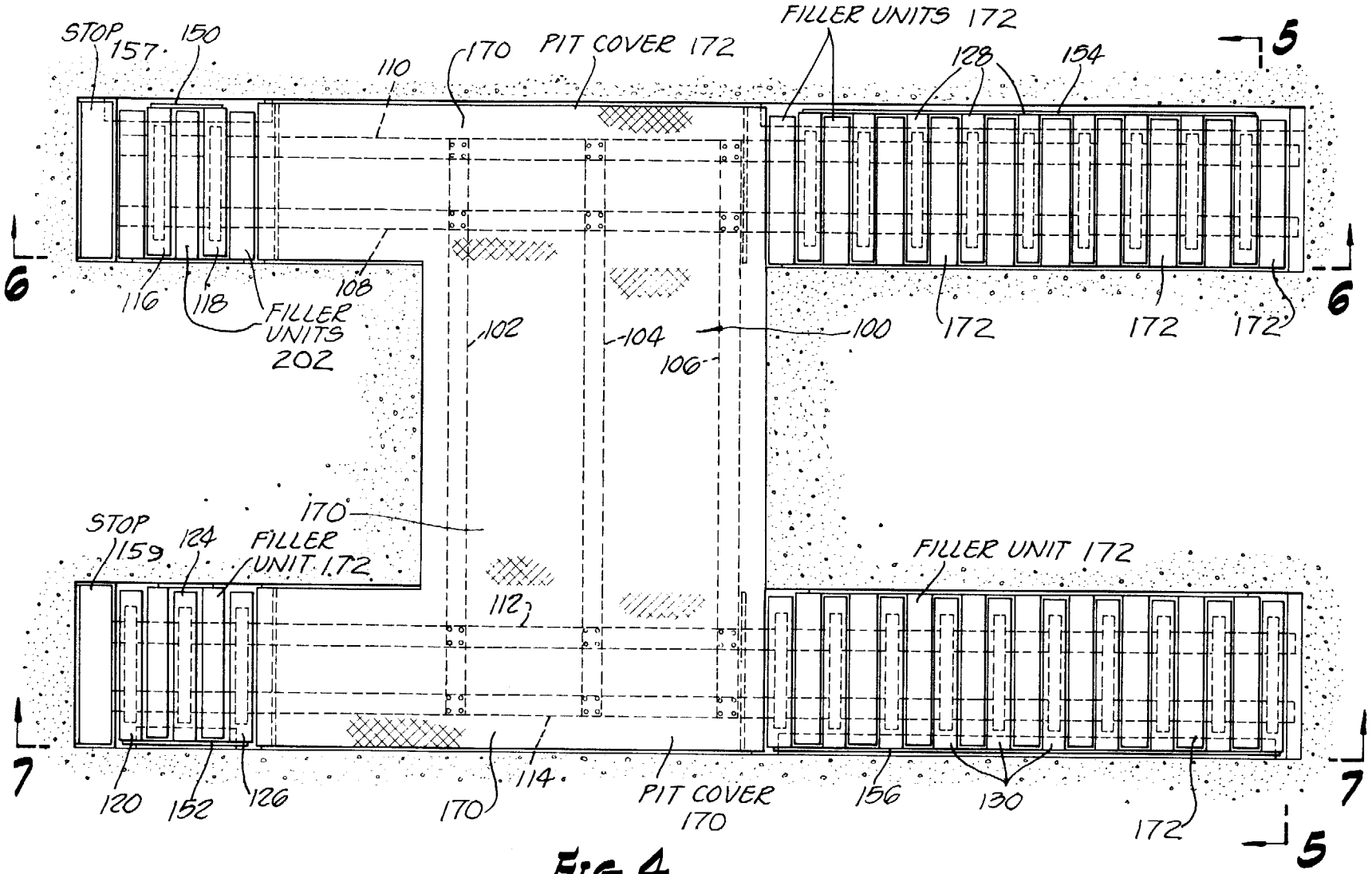
FIG. 4 is a top plan view, on an enlarged scale, of one of the cleat lift platforms of FIG. 3.

As best shown in FIGS. 4–7, the cleat lift platform 100 may be supported in an H-shaped pit at each loading location on the ground floor of each structural unit. As shown in FIG. 3, for example, ten such loading locations, designated Q–Z may be selected for a corresponding number of lift platforms 100. Each lift platform 100, as shown in FIG. 4, may comprise three intermediate traverse I-beams 102, 104 and 106 which are interconnected to two longitudinally-extending I-beams 108 and 110 at one side of the assembly and to two longitudinally-extending I-beams 112 and 114 at the other side of the assembly.

A pair of traverse cleats 116 and 118 are mounted across the forward end of the I-beams 108 and 110 to receive the right front wheel of the car to be elevated by the lift platform. Three similar cleats 120, 124 and 126 are mounted across the forward end of the I-beams 112 and 114 to receive the left front wheel of the car. A plurality of cleats designated 128 are mounted across the rear end of the I-beams 108, 110 to receive the rear right wheel of the supported car, and to accommodate cars of different lengths. A similar plurality of cleats 130 are mounted across the rear end of the I-beams 112 and 114 to receive the rear left wheel of the car. The cleats all rise from ground level when the lift platform 100 is moved to its elevated position.

Figure 5:
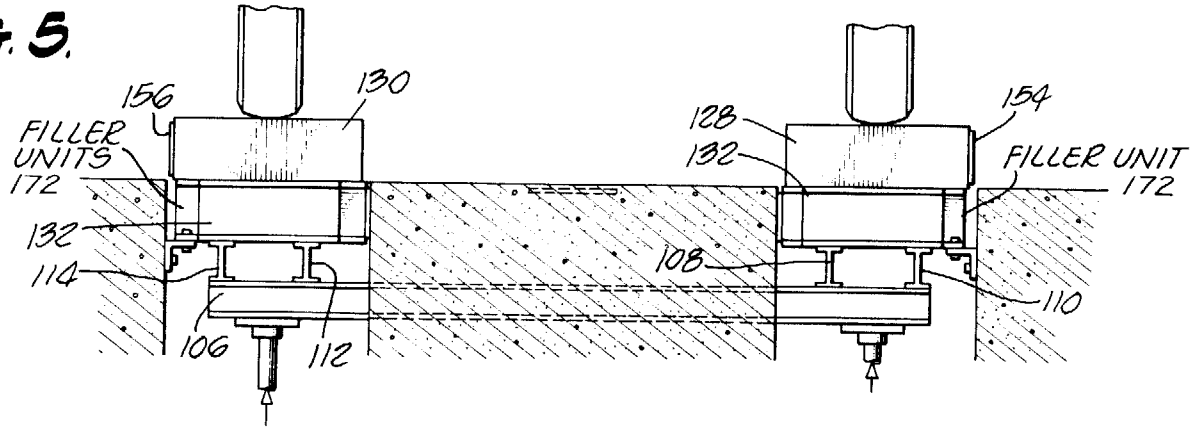
FIG. 5 is an end elevation of the cleat lift platform of FIG. 4, taken along the line 5—5.
Figure 6:
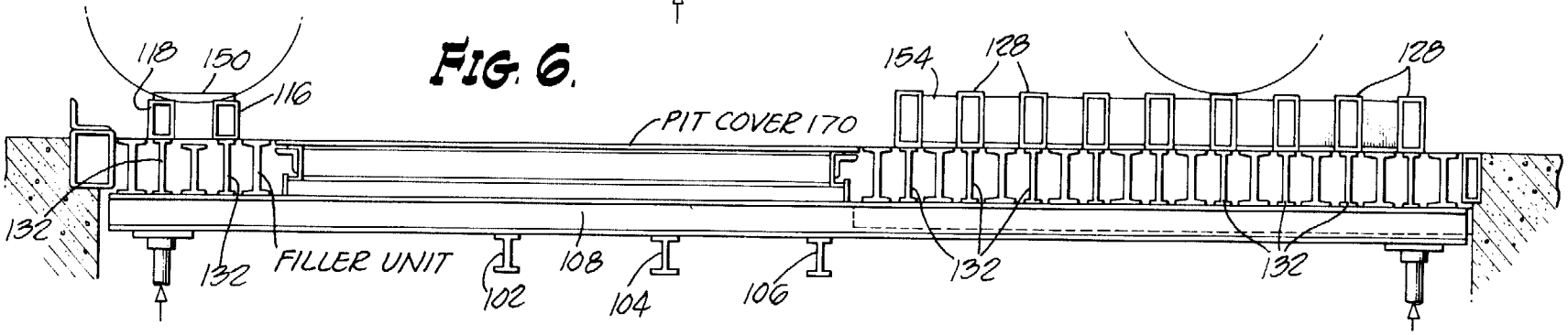
FIG. 6 is a side elevation taken along the line 6—6.
Figure 7:
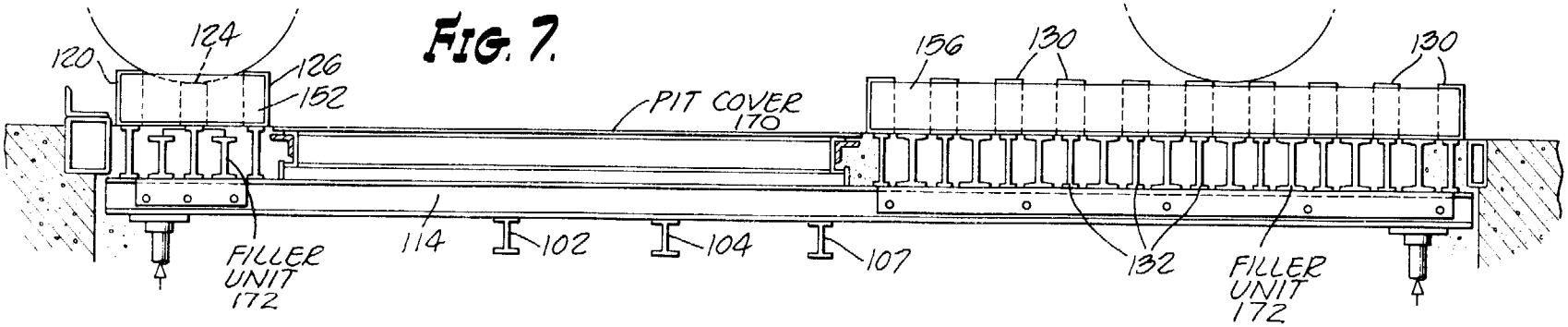
FIG. 7 is a side elevation, taken along the line 7—7.

As shown in FIGS. 5, 6 and 7, the cleats 116, 118, 120, 124, 126, 128 and 130 are all supported on appropriate I-beams 132, which in turn, are mounted on the I-beams 108, 110 and 112, 114, respectively. It will be noted from FIG. 7, that the cleat 124 is foreshortened with respect to the cleats 120 and 126, so that the three cleats form a cradle for the left front wheel of the vehicle. A side strip 150 is welded across the outer ends of the cleats 116 and 118; a side strip 152 is welded across the outer ends of the cleats 120, 124 and 126; a strip 154 is welded across the outer ends of the cleats 128; and a strip 156 is welded across the outer ends of the clets 130. A stop 157 is provided at the forward end of the I-beams 108, 110; and a stop 159 is provided at the forward end of I-beams 112, 114.

An appropriate pit cover 170 may be provided for the central portion of the lift platform, and appropriate elongated stationary filler units 172 may be provided between the various cleats 116, 118, 120, 124, 126, 128 and 130 at the ends of the platform, if so desired, to provide a smooth path for a car as it is driven onto the lift platform 100 when the lift is in its down position. The cover 170 is necessary for the pit at the central part of the platform to provide a continuous runway for the dolly between the cleats on each side of the platform.

To load a car onto the platofrm of an elevator mechanism, the lift platform 100 is set so that its top surface is essentially flush with the surface of the ground. The vehicle is then driven onto the lift platform from the right to left in FIG. 1, until the front wheels of the vehicle are received on the cleats 116, 118 and 120, 124, 126. The lift platform is then elevated so that the cleats 116, 118, 120, 124, 126, 128 and 130 all extend above the ground a selected distance. The traverse dolly T is then moved along the central runway on the lift platform between the side cleats, with its forks retracted, until its forks are aligned with the spaces between the cleats of the lift platform. The forks of the dolly are then extended between the cleats and raised, so as to lift the car up from the cleats on the lift platform. The dolly then returns with the car to the elevator mechanism, and it is hoisted by the elevator mechanism up to a selected stall on a selected upper story.

The stops 157 and 159 prevent the car supported on the lift platform from rolling off the forward end thereof.

The lift platforms 100 used for unloading are normally set in their elevated position, and the process is reversed. Then, after the dolly has returned to the elevator platform, the lift platform is lowered, so that the car may be driven off its top surface.

Figure 8:
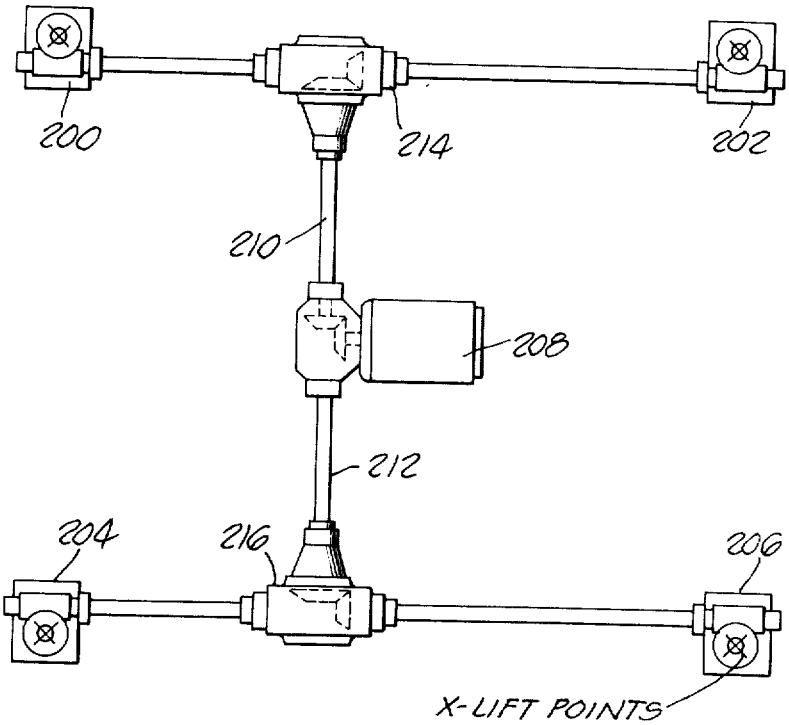
FIG. 8 is a top plan view of a lift mechanism for moving the cleat lift platform between its lower and elevation positions.

An appropriate jack mechanism for the lift platform 100 is shown in FIG. 8. The jack mechanism includes, for example, four screw type jacks designated 200, 202, 204 and 206 which are driven by an electric motor 208 through drive shafts 210 and 212, and appropriate gear coupling and shaft mechanism 214 and 216. The jack mechanism is mounted in the pit at the central part of the lift platform, and the jacks 200 and 202, for example, engage the ends of the I-beams 108 and 110, whereas the jacks 204 and 206 engage the ends of the I-beams 112 and 114. It is apparent that the jack mechanism of FIG. 8 is representative of one possible means of elevating and lowering the lift platform, and that other mechanisms, electric, hydraulic, or the like may be used.

While a particular embodiment of the invention has been shown and described, modifications may be made. The following claims are intended to cover all modifications that come within the spirit and scope of the invention.

What is claimed is:

1. In a multiple story car parking system for storing cars, the combination of: at least one multiple story structural unit having rows of adjacent storage stalls on its stories opening to an adjacent craneway; an elevator mechanism mounted in said craneway for movement along the craneway across the face of the structural unit, and including an elevator platform mounted for vertical movement to each of the stores of the unit; a self-propelled dolly with retractable transverse forks supported on said elevator platform for carrying a car from the elevator platform and for depositing the car in one of the storage stalls on one of the stories of the unit; and at least one lift platform assembly mounted in a pit on the ground floor of the structural unit adjacent the craneway, said pit having two spaced and parallel longitudinal channels aligned with the elevator platform and further having a central interconnecting portion to provide the pit with an H-shaped configuration, said lift platform assembly comprising: a plurality of beams extending transversely across the central portion of the pit and across the parallel channels; a pair of beams mounted at each end of the first-named beam and extending longitudinally along the channel at each side of the pit; a first plurality of spaced transverse elongated cleats mounted on the forward end of each of the longitudinally-extending beams and extending partially across each of the aforesaid longitudinal channels for receiving the front wheels of a car to be deposited in a storage stall; a second plurality of spaced transverse elongated cleats mounted on the rear end of each of the longitudinally extending beams and extending partially across each of the corresponding longitudinal channels for receiving the rear wheels of the car; said cleats defining spaces therebetween for receiving the forks of the dolly, and said longitudinal side channels defining a central runway therebetween for receiving the dolly when the forks thereof are retracted; and a jack mechanism mounted in the central portion of the pit and having first and second shaft respectively extending along the longitudinal channels with means at the end of each shaft for engaging each end of each of the longitudinally extending beams to move the lift platform assembly between a lower position in which a car may be driven over the cleats of the first and second pluralities, and an upper position in which the dolly may move along the central runway under the car and lift the car up from the cleats.

2. The combination defined in claim 1, and which includes stationary elongated fillter units interposed between the spaced transverse cleats of the first and second pluralities.

3. The combination defined in claim 1, and which includes a cover for the central portion of the pit.

4. The combination defined in claim 1, and which includes a selected number of said cleats of said first plurality mounted at the forward end of one of the longitudinally-extending beams, with at least one intermedite cleat thereof foreshortened, so as to provide a cradle for the front wheel of the car.

* * * * *